United States Patent [19]

Kelly

[11] Patent Number: 4,808,021

[45] Date of Patent: Feb. 28, 1989

[54] METHOD AND APPARATUS FOR STORING ACCESSORIES INSIDE A PRINTING DEVICE

[75] Inventor: Kieran B. Kelly, Vancouver, Wash.

[73] Assignee: Hewlett-Packard Company, Palo Alto, Calif.

[21] Appl. No.: 175,063

[22] Filed: Mar. 30, 1988

[51] Int. Cl.[4] ..... B41J 29/00

[52] U.S. Cl. ..... 400/717; 400/680; 400/685

[58] Field of Search ..... 400/717, 624, 625, 605, 400/680, 685, 91, 92, 93, 94; 312/185, 188

[56] References Cited

U.S. PATENT DOCUMENTS

| | | | |
|---|---|---|---|
| 3,033,339 | 5/1962 | Simms | 400/680 X |
| 3,036,687 | 5/1962 | Hoffman | 400/717 |
| 4,531,852 | 7/1985 | Madge et al. | 400/680 X |
| 4,725,157 | 2/1988 | Nakai et al. | 400/680 |

*Primary Examiner*—Edgar S. Burr
*Assistant Examiner*—Moshe I. Cohen
*Attorney, Agent, or Firm*—S. A. Kassatly; Bloor Redding, Jr.

[57] ABSTRACT

Method and apparatus for storing accessories inside a printing device, wherein the apparatus includes a storage enclosure, which is secured pivotally to the housing of the printing device, and which is capable of assuming at least one open position and one closed position. The storage enclosure is substantially housed within the carriage swept volume, when it is located in the closed position, without interfering with the path of travel of the carriage assembly, when it is in the open position. A cover protects the inner printing mechanism when the storage enclosure is in the open position. A catch mechanism retains the storage enclosure in stable open and closed positions.

19 Claims, 4 Drawing Sheets

METHOD AND APPARATUS FOR STORING ACCESSORIES INSIDE A PRINTING DEVICE

BACKGROUND OF THE INVENTION

1. Field Of The Invention

The present invention relates to the field of printing, and more particularly to a method and apparatus for storing accessories such as a battery pack, an electronic circuit board, a paper tray or other similar components, within an otherwise wasted space in a printing device, such as a printer or typewriter.

2. Background Information

Printing devices of the general type with which the present invention is concerned, relate to printers, typewriters and similar equipment having a carriage assembly used to print characters or graphics on a printing medium such as paper. The mobility of contemporary society has generally imposed limitations on the physical size and weight of these printing devices.

As a result, efforts have been made to meet the foregoing limitations by developing portable printing devices which are intended to be compact in size, and light in weight. However, none of the conventional portable printing devices has been totally satisfactory in optimizing the use of the space reserved for the sweeping movement or path of travel of the carriage assembly. The waste caused by the inability to use the swept volume during storage or transportation limits the effectiveness of the portability feature of the conventional printing devices.

An attempt to optimize the use of the volume in a portable printer has been to connect the batteries in the form of a pack, and to store the pack in a tubular platen assembly. While this solution may have contributed to some reduction of the overall size of the printer, it has not addressed the problem of reducing the waste in the swept volume of the carriage assembly.

It is therefore highly desirable to have a new and improved method and apparatus for further reducing the physical size of the printing devices, by optimizing the use of the space reserved for the swept volume of the carriage assembly, without obstructing its path of travel during operation.

SUMMARY OF THE INVENTION

It is therefore an object of the present invention to provide a new and improved method and apparatus for further reducing the physical size of the printing devices.

It is another object of the present invention to provide a new and improved method and apparatus for optimizing the use of the space reserved for the swept volume of the carriage assembly, without obstructing its path of travel during operation.

Briefly, the above and further objects and features of the present invention are realized by providing a new and improved method and apparatus for storing accessories such as a battery pack, an electronic circuit board, a paper tray or other similar components, within the otherwise wasted space of the swept volume in a printing device. The apparatus includes a storage enclosure, which is secured pivotally to the housing of the printing device, and which is capable of assuming at least one open position and one closed position. The storage enclosure is substantially housed within the carriage swept volume when it is located in the closed position, without interfering with the path of travel of the carriage assembly, when it is in the open position. A cover protects the inner printing mechanism when the storage enclosure is in the open position. A catch mechanism retains the storage enclosure in stable open and closed positions.

BRIEF DESCRIPTION OF THE DRAWINGS

The above-mentioned and other objects and features of the present invention, and the manner of attaining them will become apparent, and the invention itself will be best understood, by reference to the following description of the embodiment of the invention taken in conjunction with the accompanying drawings, wherein.

DETAILED DESCRIPTION OF THE PREFERRED EMBODIMENT

Figure 2:
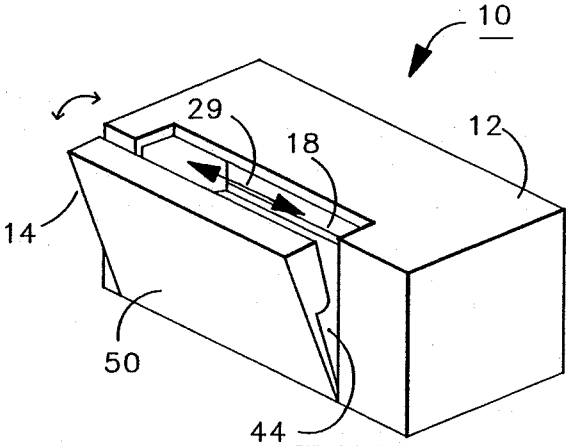
FIG. 2 is another pictorial view of the housing and storage enclosure of FIG. 1.
Figure 1:
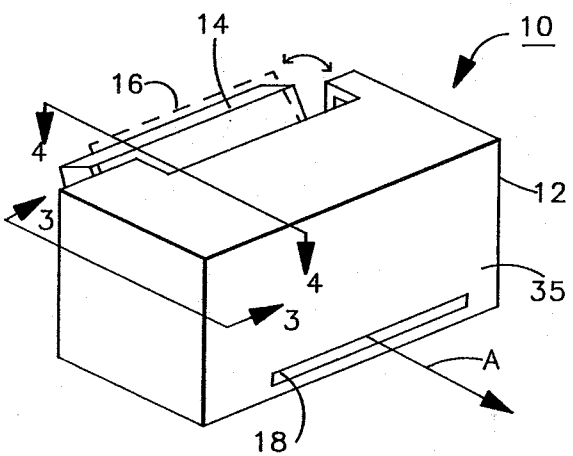
FIG. 1 is a pictorial view of a printing device embodying a housing and storage enclosure constructed in accordance with the present invention, wherein the storage enclosure is illustrated in an open position.

FIGS. 1 and 2 illustrate a printing device 10, such as a printer or a typewriter, which is constructed in accordance with the present invention. The printing device 10 generally comprises a housing or frame 12 and a storage enclosure 14. While a preferred embodiment of the internal printing mechanism will be described hereinafter in relation to FIGS. 3 through 5, it should be understood that the inventive arrangement of the housing 12 and the storage enclosure 14 can be used with various internal printing machanisms.

The storage enclosure 14 serves a dual function, namely to define a paper feed path, as well to enable storage of various accessories, such as a battery back 15 (FIG. 4), an electronic circuit, or such other similar components. The storage enclosure 14 is pivotally secured to the housing 12, and defines an input paper feed path therewith. In this manner, the storage enclosure 14 can move selectively between an upright, generally vertical closed position (FIG. 4), and an inclined open position.

In use, when it is desired to store or transport the printing device 10, the storage enclosure 14 is pivoted about the housing 12 and is retained in a closed position. However, and as illustrated in FIG. 1, when it is desired to use the printing device 10, the storage enclosure 14 is pivoted in the opposite direction, away from the housing 12, so as to enable a paper 16 to be fed along a paper feed path.

Figure 4:
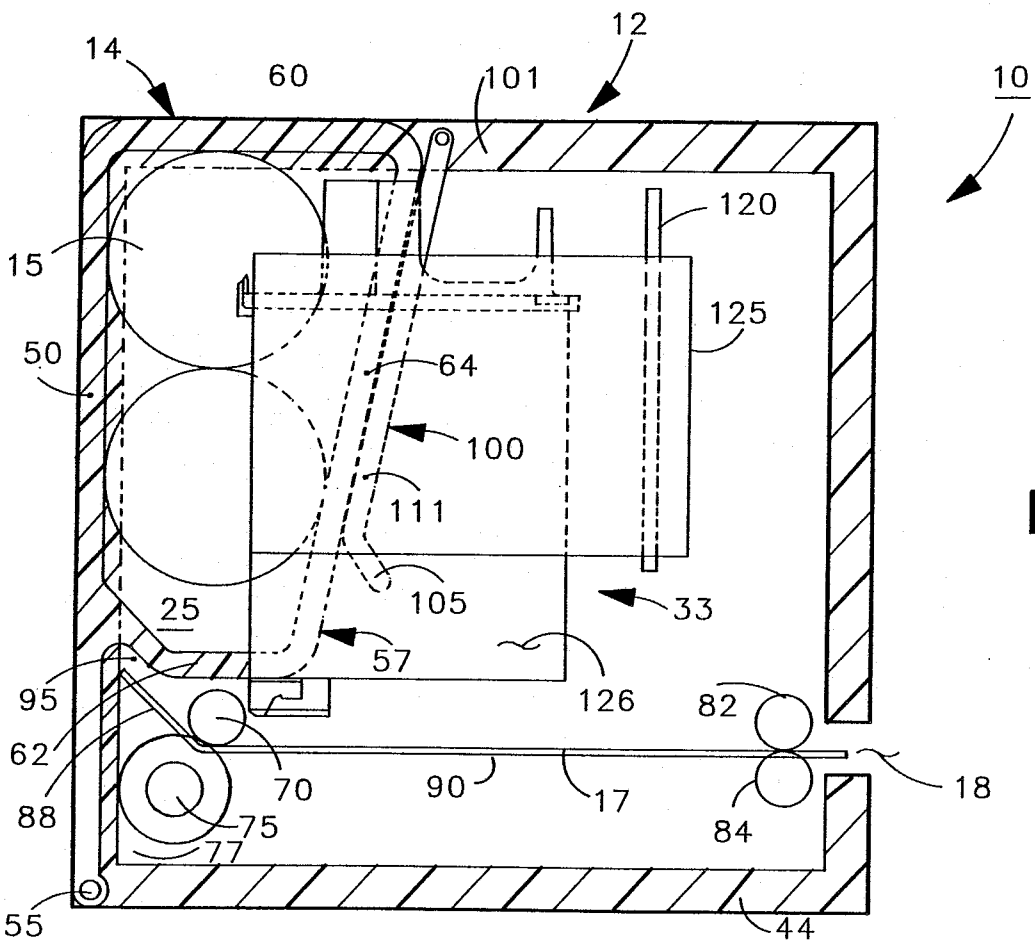
FIG. 4 is an enlarged cross-sectional side elevational view of the printing device of FIG. 1, taken on line 4—4 thereof, and illustrating the storage enclosure in a closed position.

In this position, the paper 16 rests against the storage enclosure 14, while being transferred to a platen or paper support 17 (FIG. 4). The internal printing mechanism continues to transport the paper 16 in the direction of the arrow A, through a corresponding longitudinal exit aperture 18 in the housing 12.

Figure 3:
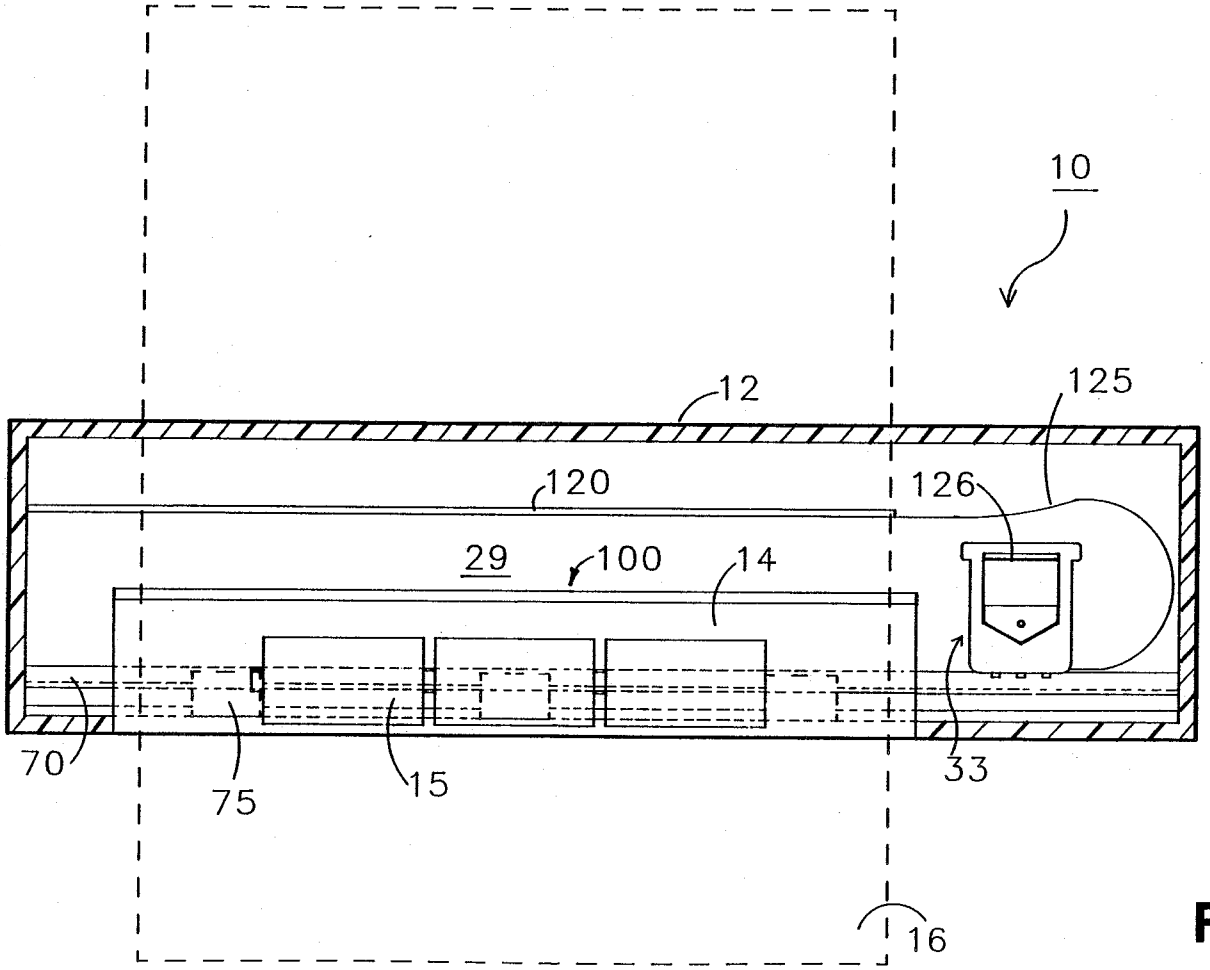
FIG. 3 is an enlarged cross-sectional top plan view of the printing device of FIG. 1, taken on line 3—3 thereof.
Figure 5:
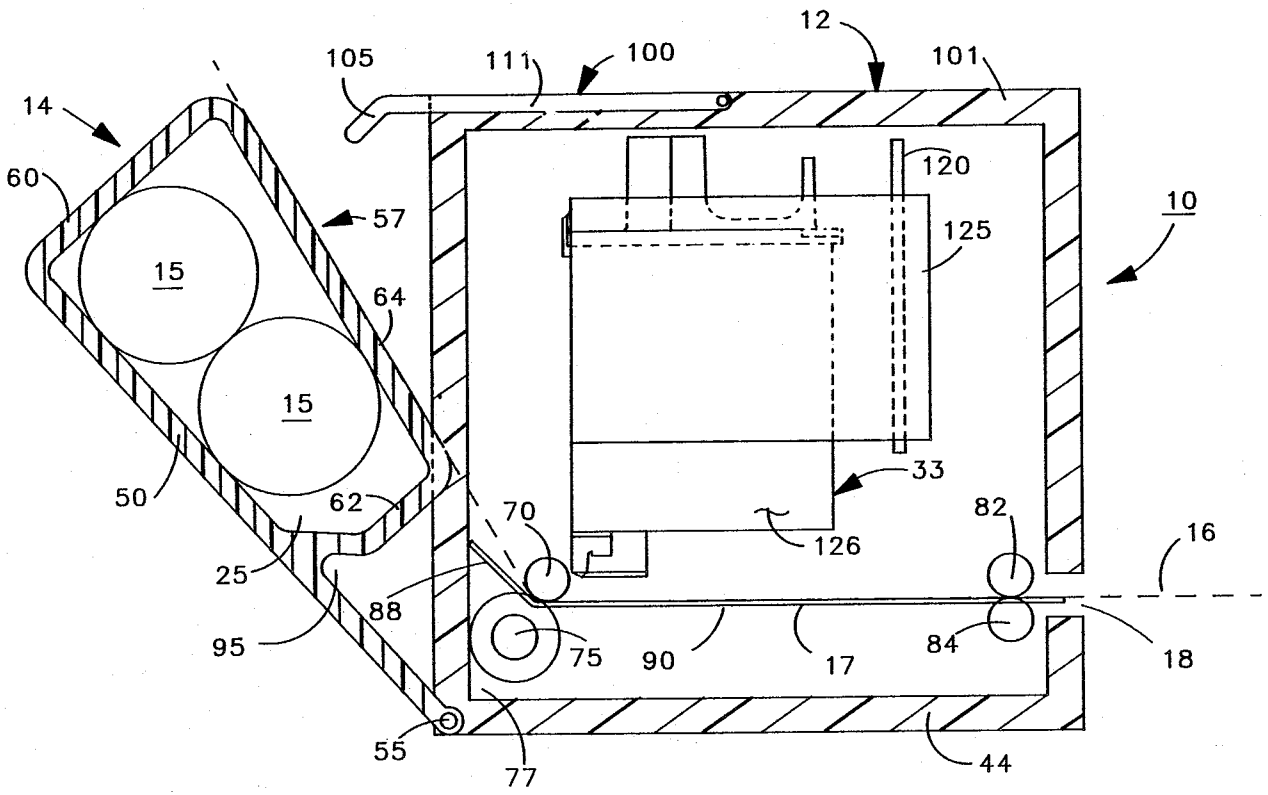
FIG. 5 is an enlarged cross-sectional side elevational view of the printing device of FIG. 1, taken on line 4—4 thereof, and illustrating the storage enclosure in an open position.

The storage enclosure 14 can be used as a storage area. In this respect, a preferred method for storing one or more accessories inside the storage enclosure 14, includes the step of positioning the storage enclosure 14 relative to the housing 12, by pivoting it to an open position, as illustrated in FIG. 5, to enable access to an inner storage chamber 25. As best illustrated in FIG. 3, once the accessory to be stored, such as a battery pack 15, is placed and secured inside the storage chamber 25, the storage enclosure 14 is pivoted back to its closed position. In this manner, both the storage enclosure 14 and the battery pack 15 are substantially housed within the swept volume 29 of a carriage assembly 33. As a result, the swept volume 29 can now be used for storage, without interfering with, nor obstructing the path of travel of the carriage assembly 33.

Considering now the housing 12 in greater detail with respect to FIGS. 1 and 2, it has a generally paralellepipedal shape, with a portion thereof cut away, in order to accommodate the storage storage enclosure 14. The housing 12 has a front face 35 which is disposed opposite to the storage enclosure 14, and which defines the longitudinal exit aperture 18. The exit aperture 18 is sized and dimensioned to enable different sizes of paper to pass therethrough. The housing 12 further includes a generally flat base member 44, for enabling the printing device 10 to rest on a generally flat surface, such as a desk.

The housing 12 is made of suitable thermoplastic material for enhancing the portability feature of the printing device 10. While the preferred embodiment of the housing 12 has been described in relation to its shape and composition, it should become apparent to those skilled in the art after reviewing the description herein, that other shapes, designs and compositions can alternatively be used.

Considering now the storage enclosure 14 in greater detail with respect to FIGS. 3 through 5, it generally comprises a substantially flat, rectangular panel 50, which is hingedly connected to the base member 44 of the housing 12, by means of a suitable pivot 55. The storage enclosure 14 further includes a generally U-shaped channel 57 which extends integrally from the panel 50, for defining the storage chamber 25.

The storage chamber 25 is elongated and generally hollow throughout its axial length, and it is suitably dimensioned to be housed almost entirely within the swept volume 29, when the storage enclosure 4 is in an upright closed position. Whereupon, the panel 50 would assume a vertical disposition, generally parallel to the front face 35.

The storage enclosure 14 has a generally P-shaped cross-section, to enable it to define a feed path for the paper 16. In this regard, the channel 57 generally includes a relatively long flat leg portion 60, a relatively short flat leg portion 62, and an interconnecting flat bight portion 64. The storage chamber 25 defined by such arrangement of the panel 50 and the channel 57 has a trapezoidally shaped crosssection The angular disposition of the bight portion 64 relative to the panel 50 permits the paper 16 to be aligned with a pinch roller 70 and a drive roller assembly 75. In this manner, the pinch roller 70 and the drive roller assembly 75 can now be closely positioned adjacent to the inner lower rear edge 77 of the housing 12, thus saving precious space therewithin, and rendering the printing device 10 more compact in size.

The generally L-shaped platen 17 supports the paper 16 during its travels between the drive roller assembly 75 and the exit aperture 18. A pair of exit rollers 82 and 84 cause the paper 16 to move forward in the direction of the arrow A. The platen 17 includes at one end thereof a first flat arm portion 88 which integrally extends from, and which is angularly disposed relative to a second flat arm portion 90.

The second arm portion 90 is substantially larger than the first arm portion 88, and it is generally parallel to the base member 44. The first arm portion 88 protrudes outwardly upwardly beyond the drive roller assembly 75, in the direction of the storage enclosure 14, so as to help guide the paper 16 inside the housing 12, between the drive roller assembly 75 and the pinch roller 70.

In this regard, upon its initial insertion, the forward end of the paper 16 can flex downwardly under the force of gravity, thereby missing the intersection of the drive roller assembly 75 and the pinch roller 70. Whereupon, the first arm portin 88 prevents the further deformation of the paper 16, and guides it inwardly. The short leg portion 62 of the channel 57 defines a notch 95 with the panel 50, for receiving the tip of the first arm portion 88, when the storage enclosure 44 is in its closed position.

The panel 50 and the channel 57 are preferably made of suitable thermoplastic material for rendering the printing device 10 lighter in weight, and thus easier to transport. It should however be understood that the storge enclosure 14 can have a different shape or can be made of another suitable material.

A generally L-shaped cover 100 is secured pivotally to the top face 101 of the housing 12, and extends about the entire length of the storge enclosure 14, for protecting the inner printing mechanism inside the housing 12. In this manner, and as illustrated in FIG. 5, when the storage enclosure 14 is in its open position, the cover 100 extends in a generally horizontal manner, beyond the housing 12 to provide added protection to the inner printing mechanism. As further illustrated in FIG. 3, the cover 100 generally extends over substantially the entire exposed portion of the swept volume 29.

When the storage enclosure 14 is moved to the closed position, the bight portion 64 of the channel 57 abuts the forward bent portion 105 of the cover 100, and causes the cover 100 to pivot inwardly inside the swept volume 29. Furthermore, the cover 100 includes a flat member 111 which is preferably designed and dimensioned to rest flat against the bight portion 64, when the storage enclosure 14 is in its closed position.

A catch or stop mechanism (not shown) can be secured to the housing 12 and the storage enclosure 14, for retaining the latter in an inclined position during use, and in a generally upright position during storage. The catch mechanism is well known to people skilled in the relevant art, and therefore it will not be described herein in greater detail. For clarity purposes, the platen 17 is illustrated in FIGS. 3 and 4 but not in FIG. 5.

The present specification and drawings do not provide a detailed description of the inner printing mechanism, in that such mechanism is well known in the art. However, for simplicity purposes, the inner printing mechanism is shown to include the carriage assembly 33, a corresponding printed circuit board 120, and an interconnecting flexible electrical ribbon or cable 125. The carriage assembly 33, in turn includes a print head 126, such as the carriage head which is commercially available and sold by Hewlett-Packard as part number 51608A.

Figure 6:
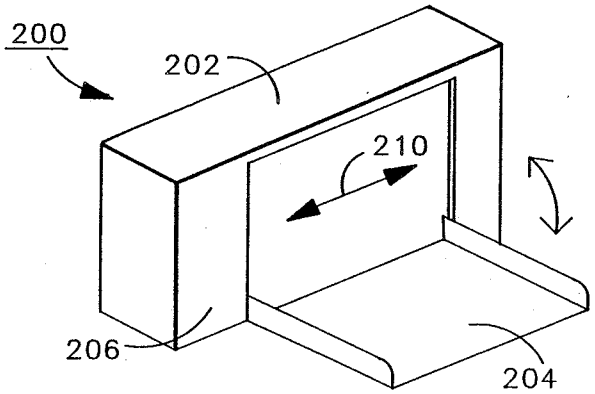
FIG. 6 is a pictorial view of another embodiment of the printer, illustrating a housing and an output tray.

FIG. 6 illustrates another printer 200 having a housing 202 and an output tray 204. The housing 202 is generally similar to the housing 12, and has a front face (not shown) and a rear face 206. The output tray is secured pivotally to the housing 202, and can be stored inside a carriage swept volume 210, within the the housing 202.

While particular embodiments of the present invention have been disclosed, it is to be understood that various different modifications are possible and are contemplated within the true spirit and scope of the appended claims. There is no intention therefore, of limitations to the exact abstract or disclosure herein presented.

What is claimed is:

1. A printing device having a movable carriage assembly and adapted for storing various components, comprising in combination:
   (a) a housing;
   (b) means for printing being substantially enclosed within said housing, and defining a carriage swept volume defined by the space into which said movable carriage may move;
   (c) enclosure means secured to the housing for enabling the storage of the accessories therewithin;
   (d) said enclosure means being capable of assuming at least one open position entirely outside the carriage swept volume and on closed position; and
   (e) said enclosure means being substantially housed within the carriage swept volume. when it is located in the closed position, without interfering with the path of travel of the carriage assembly when it is in the open position.

2. The printing device as defined in claim 1, wherein said enclosure defines a paper feed path.

3. The printing device as defined in claim 2, wherein said housing includes a cut-away portion for accommodating said enclosure means.

4. The printing device as defined in claim 3, wherein said housing defines a front longitudinal exit aperture.

5. The printing device as defined in claim 4, wherein said housing is made of suitable thermoplastic material.

6. The printing device as defined in claim 2, wherein said enclosure means includes a substantially flat panel which is pivotally connected to said housing, and a generally U-shaped channel which extends integrally from said panel, for defining a storage chamber.

7. The printing device as defined in claim 6, wherein said storage chamber is elongated and hollow throughout its axial length, and it is further suitably dimensioned to be housed almost entirely within said carriage swept volume, when said enclosure means is in its closed position.

8. The printing device as defined in claim 7, wherein said enclosure means has a generally P-shaped cross-section, to enable it to define a feed path.

9. The printing device as defined in claim 8, wherein said inner chamber has a generally trapezoidally shaped cross-section.

10. The printing device as defined in claim 9, wherein said enclosure means is substantially made of suitable thermoplastic material.

11. The printing device as defined in claim 6, further including cover means for protecting said printing means, when said enclosure means is in the open position.

12. The printing device as defined in claim 11, wherein said cover means is secured pivotally to said housing.

13. The printing device as defined in claim 12, wherein said cover means extends a relatively short distance beyond this housing, for providing added protection to said printing means.

14. The printing device as defined in claim 13, wherein said cover means extends over the exposed portion of said swept volume, when said enclosure means is in the open position.

15. The printing device as defined in claim 14, wherein said cover means is made of suitable thermoplastic material.

16. The printing device as defined in claim 2, wherein said enclosure is secured pivotally to said housing.

17. In a printing device having a movable carriage assembly, a housing, a printing mechanism substantially enclosed within the housing and defining a carriage swept volume defined by the space into which said movable carriage may move an apparatus adapted for storage accessories and comprising in combination:
   (a) enclosure means secured to the housing for enabling the storage of the accessories therewithin;
   (b) said enclosure means being capable of assuming at least one open position entirely outside the carriage swept volume and one closed position; and
   (c) said enclosure means being substantially housed within the carriage swept volume, when it is located in the closed position, without interfering with the path of travel of the carriage assembly when it is in the open position.

18. The printing device as defined in claim 18, further including cover means for protecting the printing mechanism when said enclosure means is in the open position.

19. A method for storage accessories inside a printing device having a movable carriage assembly, a housing, a storage enclosure, and a printing mechanism substantially enclosed within the housing and defining a carriage swept volume defined by the space into which said movable carriage may move, the method comprises the steps of:
   (a) positioning the storage enclosure to an open position entirely outside the carriage swept volume;
   (b) storing the accessories within the storage enclosure; and
   (c) positioning the storage enclosure in the opposite direction to a closed position within the carriage swept volume, without interfering with the path of travel of the carriage assembly, when it is in the open position.

* * * * *